United States Patent [19]

Satake

[11] 4,301,931

[45] Nov. 24, 1981

[54] GRAIN SORTER

[75] Inventor: Toshihiko Satake, Higashihiroshima, Japan

[73] Assignee: Satake Engineering Co., Ltd., Tokyo, Japan

[21] Appl. No.: 141,160

[22] Filed: Apr. 17, 1980

[51] Int. Cl.[3] ..... B07C 9/00

[52] U.S. Cl. ..... 209/691

[58] Field of Search ..... 209/691, 692, 693, 694, 209/695, 696

[56] References Cited

U.S. PATENT DOCUMENTS

| | | | |
|---|---|---|---|
| 1,466,560 | 8/1923 | Raze | 209/691 |
| 2,281,174 | 4/1942 | Steele | 209/694 |
| 2,954,124 | 9/1960 | Young | 209/691 X |
| 3,211,288 | 10/1965 | Peis | 209/692X |

*Primary Examiner*—Allen N. Knowles

*Attorney, Agent, or Firm*—Norbert P. Holler; Charles A. Blank

[57] ABSTRACT

A grain sorter including a machine frame, at least one grain sorting board and a device for moving the grain sorting board in swinging movement including a mounting mechanism for mounting the grain sorting board on the machine frame in such a manner that the grain sorting board is inclined in one direction at a certain angle of inclination with respect to the horizontal, a swinging mechanism for moving the grain sorting board in swinging movement at an angle larger than the angle of inclination of the grain sorting board, and an adjusting mechanism for adjusting the angle of inclination of the grain sorting board. The mechanism for adjusting the angle of inclination of the grain sorting board is incorporated in the device for moving the grain sorting board in swinging movement within the limit set by the heights of the mounting mechanism and the swinging mechanism, so as to lower the center of gravity of the grain sorting board and avoid production of irregular vibration of the grain sorting board.

4 Claims, 4 Drawing Figures

GRAIN SORTER

BACKGROUND OF THE INVENTION

This invention relates to a grain sorter provided with a grain sorting board and a device for moving the grain sorting board in swinging movement, and more particularly it is concerned with improvements in or relating to the device for moving the grain sorting board in swinging movement.

This type of grain sorter comprises a grain sorting board of rectangular shape having a coarse surface mounted in inclined position such that it is inclined in one direction thereof at a certain angle of inclination with respect to the horizontal and crosswise thereof too so that it is higher at one end and at one side and lower at the other end and at the other side, and a device for moving the grain sorting board in swinging movement at an angle larger than the angle of inclination. The grain sorter of the type described is constructed such that when dissimilar grain particles, such as unhulled rice and hulled rice, are supplied in mingling condition to one end of the higher side of the grain sorting board, the particles of hulled rice flow on the higher end and the particles of unhulled rice flow on the lower end owing to differences in the coefficient of friction and specific gravity between the two dissimilar grain particles, so that the particles of hulled rice and the particles of unhulled rice can be sorted and the former are discharged through the higher level portion of a grain outlet at the lower side and the latter are discharged through a lower level portion of the grain outlet at the lower side.

When the weight of the grain particles on the grain sorting board or the weight of the grain sorting board is excessively heavy, irregular vibration might be caused to occur by inertia. Also, when the device for moving the grain sorting board in swinging movement lacks balance, irregular vibration might occur. As a result, regular vibration of the grain sorting board would be interfered with and consequently the precision with which grain sorting is effected would be greatly reduced. To obviate this defect, it is essential that the weight of the swinging portion be reduced as much as possible and the center of gravity of the grain sorting board be lowered as much as possible. These are two important factors concerned in keeping the stability of the grain sorter in operation.

To efficiently carry out a grain sorting operation of high precision, it is necessary to build into the grain sorting board swinging device a mechanism for adjusting the angle of inclination of the grain sorting board so that the angle of inclination of the grain sorting board can be adjusted depending on the flow rate of grain particles, the mixing rate of dissimilar grain particles and the type of grain particles, to enable substantially the entire surface of the grain sorting board to be covered with the grain particles at all times. In this type of grain sorter of the prior art, it has hitherto been customary that the mechanism for adjusting the angle of inclination of the grain sorting board is located below the device for moving the grain sorting board in swinging movement. When this construction is used, the center of gravity of the grain sorting board is disposed at a high level, thereby making it insufficient for the grain sorting board to meet the requirements described hereinabove for enabling the grain sorter to show a stable performance.

SUMMARY OF THE INVENTION

This invention has as its object the provision of a grain sorter of high efficiency and high precision wherein the device for moving the grain sorting board in swing movement is disposed at a lowest possible level so that a compact overall size can be obtained in a grain sorter and the grain sorting board can be moved in regular swinging movement free from irregular vibration.

According to the invention, there is provided a grain sorter comprising a machine frame, at least one grain sorting board having a coarse surface, and a device for moving the grain sorting board including a mounting mechanism comprising a pair of pivotal links connected to a lower end of the grain sorting board and another pair of pivotal links connected to a higher end thereof for mounting the grain sorting board for swinging movement on the machine frame in such a manner that the grain sorting board is inclined in one direction at a certain angle of inclination with respect to the horizontal, a swinging mechanism for moving the grain sorting board in swinging movement having a rotary shaft supported by the machine frame and including an eccentric portion for moving the grain sorting board in swinging movement at a swinging angle larger than the angle of inclination of the grain sorting board, and a mechanism for adjusting the angle of inclination of the grain sorting board operatively connected to the mounting mechanism, wherein the improvement resides in that the mechanism for adjusting the angle of inclination of the grain sorting board is incorporated in the device for moving the grain sorting board in swing movement within the limit set by the heights of the mounting mechanism and the swinging mechanism to enable the center of gravity of the grain sorting board to be disposed at a low level.

The foregoing and still other advantages of the present invention will become more apparent from the following detailed explanation of the preferred embodiment of the invention with the accompanying drawings, in which.

DETAILED DESCRIPTION OF THE PREFERRED EMBODIMENT

To enable the present invention to be thoroughly understood, a grain sorter of the prior art shown in FIGS. 1 and 2 will first be described.

Figure 1:
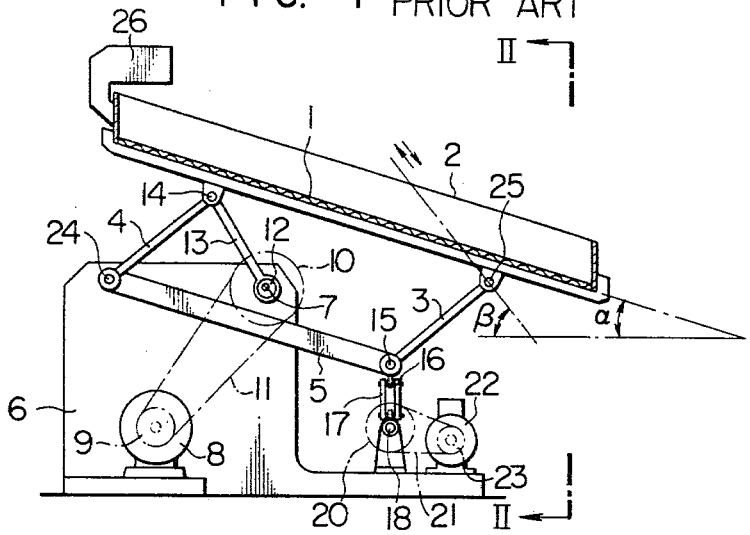
FIG. 1 PRIOR ART
FIG. 1 is a sectional side view of a grain sorter of the prior art.
Figure 2:
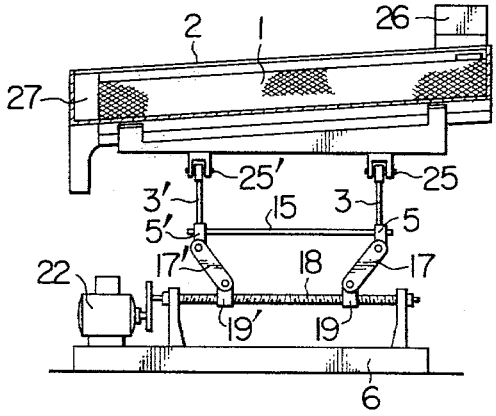
FIG. 2 PRIOR ART
FIG. 2 is a sectional view taken along the line II—II in FIG. 1.

Referring to FIGS. 1 and 2, a frame 2 supporting a grain sorting board 1 is supported in turn on support rods 5 and 5' by a pair of pivotal links 3 and 3' disposed in tilting position on the low level side of the grain sorting board 1 and by another pair of pivotal links 4 and 4' disposed in tilting position on the high level side of the grain sorting board 1 in such a manner that the grain sorting board 1 forms an angle of inclination $\alpha$ with the horizontal. A main shaft 7 is rotatably supported by side walls (one of which is shown in FIG. 1) of a machine frame 6 of the grain sorter supporting thereon a main electric motor 8 having a pulley 9 mounted on its output shaft. A belt 11 is trained over the pulley 9 and another pulley 10 mounted on the main shaft 7 to drive the main shaft 7 for rotation as the main electric motor 8 is actuated. The main shaft 7 has mounted thereon an eccentric ring 12, and a rod 13 embracing at its major diameter end the eccentric ring 12 is pivotally connected at the other end thereof to a support shaft 14 serving as an upper fulcrum of the pivotal link 4 on the frame 2. By this arrangement, rotation of the main shaft 7 causes, by the action of the eccentric ring 12, the grain sorting board 1 to move in swinging movement in the directions of arrows shown in FIG. 1 at a swinging angle $\beta$ greater than the angle of inclination $\alpha$ of the grain sorting board 1.

A support shaft 15 serving as a lower fulcrum for the pivotal link 3 to be pivotally connected to the support rod 5 has lugs 16 attached to either end thereof and having adjusting rods 17 and 17' connected thereto respectively, each adjusting rod consisting of two members disposed on opposite sides of the lug 16 and pivotally connected at one end thereof to the lug 16 while being pivotally connected at the other end thereof to nuts 19 and 19' respectively threadably connected to oppositely threaded portions of a threaded shaft 18 rotatably supported on the machine frame 6. Mounted at one end of the threaded shaft 18 is a pulley 20 connected to a pulley 23 mounted on an adjusting electric motor 22 through a belt 21 trained over the two pulleys 20 and 23. Thus by rotating the adjusting electric motor 22 in the normal direction or the reverse direction, the two nuts 19 and 19' can be moved on the threaded shaft 18 toward or away from each other, to move the support shaft 15 or the lower fulcrum vertically via the adjusting rods 17 and 17' and the lugs 16.

An end 24 of the support rod 15 serving as a lower fulcrum for the pivotal link 4 is pivotally secured to the machine frame 6, so that the movement of the lower fulcrum 15 vertically moves, via the pivotal links 3 and 3', upper fulcrums 25 and 25' for the links 3 and 3' respectively with respect to the frame 2, so as to thereby adjust the angle of inclination $\alpha$ of the grain sorting board 1 with respect to the horizontal. From the description set forth hereinabove, it will be appreciated that the mechanism for adjusting the angle of inclination of the grain sorting board 1 comprising the lugs 16, adjusting rods 17 and 17', nuts 19 and 19', threaded shaft 18, pulleys 20 and 23, belt 21 and adjusting electric motor 18 is disposed below the device for moving the grain sorting board in swinging movement to enable the center of gravity of the grain sorting board 1 to be disposed at a high level.

Operation of the grain sorter of the aforesaid construction will be described by using, as an example, a mixture of the grains of unhulled rice and hulled rice which is supplied to the grain sorting board 1 through a grain supply portion 26 disposed at a higher side of a higher end of the board 1. The grain sorting board 1 is inclined as shown in FIG. 1 and also crosswise thereof or in a direction at right angles to the direction of inclination as shown in FIG. 2, so that swinging movement of the grain sorting board 1 causes the grains of hulled rice to flow on the higher end of the board 1 and the grains of unhulled rice to flow on the lower end thereof in moving from right to left in FIG. 2, so that the sorted grains of hulled rice and unhulled rice are discharged through different parts of a grain discharge portion 27 of the board 1.

Figure 3:
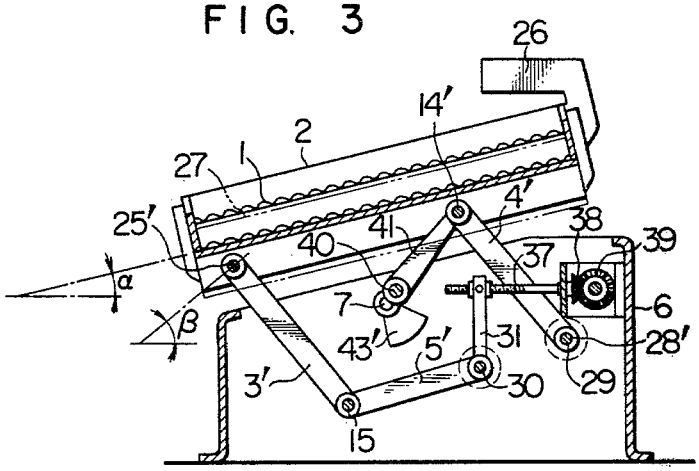
FIG. 3 is a sectional view, taken along the line III—III in FIG. 4, of the grain sorter comprising one embodiment of the invention.
Figure 4:
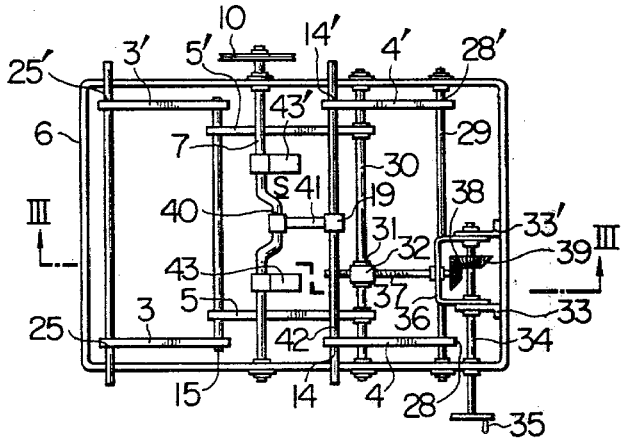
FIG. 4 is a plan view of the grain sorter shown in FIG. 3 from which the grain sorting boards have been removed.

The preferred embodiment of the invention shown in FIGS. 3 and 4 will now be described. FIG. 3 shows in a sectional side view the grain sorter according to the invention as viewed from a direction opposite to the direction from which the grain sorter shown in FIG. 1 is viewed. The grain sorter shown in FIG. 3 has two grain sorting boards 1, and the frame 2 has the pivotal links 3 and 3' pivotally connected thereto at their fulcrums near the lower end of the frame 2 and the links 4 and 4' pivotally connected thereto at their fulcrums near the higher end thereof. The pivotal links 3 and 3' near the lower end of the frame 2 are pivotally connected at the lower ends thereof to the support shaft 15 serving as their lower fulcrums which is securedly connected to the support rods 5 and 5' at one end thereof. The pivotal links 4 and 4' near the higher end of the frame 2 are pivotally connected at lower fulcrums 28 and 28' thereof respectively to a shaft 29 connected to the machine frame 6. The support rods 5 and 5' are connected at the other end thereof to a support shaft 30 rotatably supported by the machine frame 6 so that the support rods 5 and 5' and support shaft 30 act as a unit.

A lever 31 having a bifurcated upper end portion extends upwardly from the support shaft 30 for pivotally supporting a nut 32 in the bifurcated upper end portion. Mounted on one end wall of the machine frame 6 and disposed parallel to each other in spaced juxtaposed relation are brackets 33 and 33' which support for rotation an adjusting shaft 34 extending at one end thereof through one side wall of the machine frame 6 and having a handle 35 attached thereto. A U-shaped member 36 is supported for pivotal movement by the adjusting shaft 34 in a portion thereof between the two brackets 33 and 33'. The U-shaped member 36 supports for rotation a threaded shaft 37 having a threaded portion threadably engaging said nut 32 near one end thereof, and supports at the other end thereof a bevel gear 38 in meshing engagement with another bevel gear 39 on the adjusting shaft 34.

The main shaft 7 rotatably supported by two side walls of the machine frame 6 and supports at its outer end the drive pulley 10. The main shaft 7 has in its central portion an eccentric portion 40 supporting one end of a rod 41 for rotation which is pivotally supported at the other end thereof by a support shaft 42 supported by the frame 2 and serving as upper fulcrums 14 and 14' for the pivotal links 4 and 4' respectively near the higher end of the frame 2. The main shaft 7 carries balance weights 43 and 43' on either side of the eccentric portion 40. Thus rotation of the main shaft 7 causes the grain sorting boards 1 to move in swinging movement at an angle $\beta$ in the same manner as described by referring to the grain sorter of the prior art shown in FIGS. 1 and 2.

As is clear in FIGS. 3 and 4, the support rods 5 and 5' are disposed below the eccentric portion 40 and balance weights 43 and 43' of the main shaft 7 in such a manner that they provide with a space S therebetween which do not interfere with the rotary movements of these parts. The support rods 5 and 5' support at their lower ends the support shaft 15 which serves as the lower fulcrums for the pivotal links 3 and 3' disposed at the lower end of the frame 2 which extend obliquely upwardly from their lower fulcrums toward the lower end of the frame 2 to be connected to the frame 2 for the grain supporting boards 1 at upper fulcrums 25 and 25' thereof. Thus when the handle 35 is operated to rotate the adjusting shaft 34, the threaded shaft 37 is rotated via the bevel gears 38 and 39, to thereby move the nut 32 on the threaded shaft 37. Since the nut 32 is supported in the bifurcated upper end portion of the lever 31, movement of the nut 32 causes rotation of the support shaft 30 to which the lever 31 is connected. As a result, the support rods 5 and 5' acting as a unit with the support shaft 30 rotate with the support shaft 30, to thereby move substantially upwardly or downwardly the lower fulcrums 15 of the pivotal links 3 and 3' connected to the support rods 5 and 5'. Vertical movement of the lower fulcrums 15 vertically moves the upper fulcrums 25 and 25' via the pivotal links 3 and 3'. This moves upwardly or downwardly the lower end of the frame 2 for the grain sorting boards 1 which is supported by the pivotal links 3 and 3', to thereby enable the angle of inclination $\alpha$ of the grain sorting boards 1 to be adjusted. The mechanism for adjusting the angle of inclination of the grain sorting board comprising the support rods 5 and 5' and the members 30 to 39 is located within the limit set by the height of the device for moving the grain sorting board in swinging movement and assembled therewith. It will be appreciated, therefore, that as compared with the grain sorter of the prior art shown in FIGS. 1 and 2, the grain sorter according to the invention is constructed in a manner to have the center of gravity of the grain sorting boards 1 at a lower level than the center of gravity of the grain sorting board 1 of the prior art in which the mechanism for adjusting the angle of inclination of the grain sorting board is located below and incorporated in the device for moving the grain sorting board in swinging movement. The invention makes it possible to obtain a compact overall size in a grain sorter, to ensure that the grain sorting board moves in swinging movement while being free from irregular vibration at its low center of gravity, and to perform grain sorting operation with a high degree of efficiency and precision.

When dissimilar particles of grain, such as unhulled rice and hulled rice, are supplied to the two grain sorting boards 1 at one side of the higher end of the grain sorting boards (the right end in FIG. 3), the dissimilar particles of grain flow along different courses, as described by referring to the grain sorter shown in FIGS. 1 and 2, and flow as viewed in FIG. 3 in the direction from the backside of the drawing sheet toward the front side thereof, so that the grain particles are sorted during their flow and discharged through the discharge portion 27 at the front side of the grain sorting board from the grain sorter.

What is claimed is:

1. A grain sorter comprising:

a machine frame;

at least one grain sorting board having a coarse surface; and a device for moving the grain sorting board in swinging movement including a mounting mechanism comprising a pair of pivotal links connected to a lower end of the grain sorting board and another pair of pivotal links connected to a higher end thereof for mounting the grain sorting board for swinging movement on the machine frame in such a manner that the grain sorting board is inclined in one direction at a certain angle of inclination with respect to the horizontal, a swinging mechanism for moving the grain sorting board in swinging movement having a rotary shaft supported by the machine frame and including an eccentric portion for moving the grain sorting board in swinging movement at a swinging angle larger than the angle of inclination of the grain sorting board, and a mechanism for adjusting the angle of inclination of the grain sorting board operatively connected to the mounting mechanism; wherein the improvement resides in that the mechanism for adjusting the angle of inclination of the grain sorting board is incorporated in the device for moving the grain sorting board in swinging movement within the limit set by the heights of said mounting mechanism and said swinging mechanism to enable the center of gravity of the grain sorting board to be disposed at a low level.

2. A grain sorter as claimed in claim 1, wherein said mechanism for adjusting the angle of inclination of the grain sorting board comprises a support shaft rotatably supported by two side walls of the machine frame, a pair of support rods extending lengthwise of the sorter and providing at opposite ends thereof lower fulcrums for the pair of pivotal links connected to the lower end of the grain sorting board, a lever extending upwardly from the support shaft, and operating means connected to an end portion of said lever for rotating the support shaft in the normal direction and the reverse direction.

3. A grain sorter as claimed in claim 2, wherein a space necessary for an eccentric portion of said rotary shaft to rotate therein is provided between said two support rods.

4. A grain sorter as claimed in claim 2 or 3, wherein said operating means comprises a nut supported at one end of said lever, a threaded shaft having said nut threadably connected thereto, and a means for rotating said threaded shaft in the normal direction and the reverse direction.

* * * * *